US009021827B2

(12) United States Patent
Lee

(10) Patent No.: US 9,021,827 B2
(45) Date of Patent: May 5, 2015

(54) ICE MAKER AND REFRIGERATOR INCLUDING THE SAME

(75) Inventor: Nam Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 488 days.

(21) Appl. No.: 13/497,330

(22) PCT Filed: Oct. 8, 2010

(86) PCT No.: PCT/KR2010/006881

§ 371 (c)(1),
(2), (4) Date: Mar. 21, 2012

(87) PCT Pub. No.: WO2011/043615

PCT Pub. Date: Apr. 14, 2011

(65) Prior Publication Data

US 2012/0216561 A1 Aug. 30, 2012

(30) Foreign Application Priority Data

Oct. 8, 2009 (KR) ..... 10-2009-0095631

(51) Int. Cl.
*F25C 5/08* (2006.01)
*F25C 1/22* (2006.01)
*F25C 5/18* (2006.01)

(52) U.S. Cl.
CPC ..... *F25C 5/08* (2013.01); *F25C 2305/022* (2013.01); *F25C 2400/10* (2013.01)

(58) Field of Classification Search
USPC ..... 62/340–356
See application file for complete search history.

(56) References Cited

U.S. PATENT DOCUMENTS

| | | | | |
|---|---|---|---|---|
| 5,992,167 | A * | 11/1999 | Hill et al. | 62/188 |
| 6,112,540 | A * | 9/2000 | Serrels et al. | 62/351 |
| 6,658,869 | B1 * | 12/2003 | Thornbrough | 62/137 |
| 8,104,297 | B2 * | 1/2012 | Heger et al. | 62/73 |
| 2006/0266055 | A1 * | 11/2006 | Anderson et al. | 62/135 |
| 2007/0220909 | A1 * | 9/2007 | An et al. | 62/137 |
| 2009/0178420 | A1 * | 7/2009 | Amonett et al. | 62/73 |

FOREIGN PATENT DOCUMENTS

| | | | |
|---|---|---|---|
| EP | 1 798 500 | A2 | 6/2007 |
| KR | 10-0662445 | B1 | 1/2007 |

OTHER PUBLICATIONS

Lee et al., Ice Maker, Dec. 21, 2006, Korean Intellectual Property Office, 10-0662445, all.*

International Search Report and Written Opinion dated Apr. 5, 2012 issued in Application No. PCT/KR2010/006881.

* cited by examiner

*Primary Examiner* — Stephen M. Gravini
*Assistant Examiner* — Filip Zec
(74) *Attorney, Agent, or Firm* — KED & Associates LLP

(57) ABSTRACT

An ice maker including a heating type ice-making tray capable of securing ice ejecting and a refrigerator including the ice maker are disclosed. According to a refrigerator including the ice maker, the ice may be securely ejected from the ice-making tray. As a result, reliability of ice ejecting may be improved. The water generated when the ice is ejected in the ice maker may be prevented from falling to an ice container efficiently.

15 Claims, 7 Drawing Sheets

(a)

(b)

ICE MAKER AND REFRIGERATOR INCLUDING THE SAME

TECHNICAL FIELD

The present invention relates to an ice maker configured to make ice by using cold air and a refrigerator including the same, more particularly, to an ice maker including an ice tray to eject ice based on a heating type, which can secure confident ice ejection, and a refrigerator including the ice maker.

Background Art

Generally, refrigerators are electric appliances which can freeze and refrigerate storing objects based on a refrigerant cycle configured of compression, condensation, expansion and evaporation.

Such a refrigerator includes key parts of a cabinet, doors and an ice-maker. The cabinet includes at least one storage chamber and the door is coupled to the cabinet to close the inside of the cabinet. The ice-maker is provided in the storage chambers or the door.

In addition, an ice bank configured to store ice discharged from the ice maker therein may be provided in the storage chamber or the door. The ice bank is connected with a dispenser configured to discharge ice and it allows the ice discharged outward according to a user's selection.

The ice maker may be categorized into a heating type ice maker and a twisting type ice maker. According to the heating type ice maker, a heater heats an ice-making tray to melt an interface between ice cubes and an ejector is rotated to eject the ice. According to the twisting type ice maker, a twisting force is applied to an ice-making tray made of synthetic resin to eject ice.

The heating type ice maker includes an ice-making tray configured to form an ice making chamber in which ice is made, a water supply valve configured to supply water to the ice making chamber, a heater mounted in a lower surface of the ice-making tray, an ejector configured to eject the ice made in the ice-making tray outside, a driving device configured to drive the ejector and an ice bank configured to contain the ice transported from the ice-making tray.

In a predetermined time period after water is supplied to the ice-making tray via the water supply valve, ice is made in the ice-making tray. Then, the heater is controlled to be on for a predetermined time period until the ice is separated from the ice-making tray. If the ejector is rotated after that, the ice is lifted to be ejected outside of the ice-making tray. The ice ejected from the ice-making tray is contained in the ice bank. When the user pushes a switch provided in the dispenser, some of the ice is discharged from an ice-outlet of the dispenser.

According to the conventional ice maker described above, the heater has to heat the ice-making tray enough to eject the ice inside the ice-making tray outside. Because of that, the ice might be melt too much and water might be sparkled together when the ice is ejected. The water sparkling from the ice-making tray is drawn into the ice bank and it makes the ice stuck together inside the ice bank. As a result, it is difficult to discharge the ice contained in the ice bank via the dispenser of the refrigerator automatically.

In addition, one of the heating type ice makers rotates the ice-making tray by a predetermined angle after heating the ice-making tray, and it allows ice to be dropped by its weight to eject the ice.

However, if the ice-making tray of such the ice-maker is heated too much, water is generated too much to fall disadvantageously. If the heating of the ice-making tray is not enough, the ice fails to be separated from the ice-making tray disadvantageously.

Also, if the ice failed to be ejected, water supply and water cooling would be performed to the returning ice-making tray. Because of that, water might overflow and reliability of the ice maker might be deteriorated.

DISCLOSURE OF INVENTION

Technical Problem

To solve the problems, an object of the present invention is to provide an ice maker which can prevent water generated in ejecting ice from falling to an ice bank effectively and a refrigerator including the same, and to improve reliability of ice-ejecting performed in a heating type ice maker.

Solution to Problem

To achieve these objects and other advantages and in accordance with the purpose of the invention, as embodied and broadly described herein, an ice maker includes an ice-making tray configured to make ice; a heat source configured to heat the ice-making tray to eject the ice from the ice-making tray; a driving controller configured to rotate the ice-making tray selectively and to control the heat source to be on and off; and an auxiliary ejecting device configured to press the ice to help the ice ejecting when the ice-making tray heated by the heat source is rotated to eject the ice.

The auxiliary ejecting device may include an auxiliary ejecting member having an end contacting with the ice to eject; and an elastic member configured to restitute the auxiliary ejecting member after ejecting the ice.

The auxiliary ejecting member may be rotatable with respect to a shaft secured to an upper portion of the ice-making tray and the elastic member may be a torsion spring.

The auxiliary ejecting device may further include a switch configured to be on and off based on contact with the other end of the auxiliary ejecting member when moved by the ice located in the rotating ice-making tray, to determine whether the ice-making tray completes the ice ejecting.

The auxiliary ejecting member may include an ice contacting portion configured to contact with the ice when the ice-making tray is rotated; and a switch contacting portion configured to contact with the switch after rotated together with the ice contacting portion, the switch contacting portion bent to be connected with the ice contacting portion.

The driving controller may determine that the ice ejecting is not completed and the driving controller may continue the ice ejecting until the switch is off after the auxiliary ejecting member contacts with the switch to allow the switch to be on.

The ice-making tray after heated to eject the ice may be rotated at a predetermined angle more than 90° and the auxiliary ejecting member may start to contact with the ice located in the ice-making tray just before the rotation of the ice-making tray is completed.

The ice maker may further include a water-falling-preventing bracket provided in the ice-making tray to collect water generated when the ice located in the ice-making tray is ejected therein, preventing the water from falling outside.

The water-falling-preventing bracket may include a slope surface configured to allow the collected water to flow into the ice-making tray when the ice-making restitutes after completing the ice ejecting.

The slope surface may be oblique downward to the ice-making tray with respect to a horizontal surface.

The water-falling-preventing bracket may further include a heat-transmission-promoting member configured to transmit the heat of the heat source to the water-falling-preventing bracket efficiently, the heat-transmission-promoting member provided between the water-falling-preventing bracket and the heat source.

In another aspect of the present invention, a refrigerator includes a cabinet comprising a storage chamber; a door rotatably coupled to the cabinet to open and close the storage chamber; and an ice maker provided in the storage chamber or the door.

The ice maker may include an ice-making tray configured to make ice; a heat source configured to heat the ice-making tray to eject the ice from the ice-making tray; a driving controller configured to rotate the ice-making tray selectively and to control the heat source to be on and off; and an auxiliary ejecting device configured to press the ice to help the ice ejecting when the ice-making tray heated by the heat source is rotated to eject the ice.

The auxiliary ejecting device may include an auxiliary ejecting member having an end contacting with the ice to eject; and an elastic member configured to restitute the auxiliary ejecting member after ejecting the ice.

The auxiliary ejecting member may be rotatable with respect to a shaft secured to an upper portion of the ice-making tray and the elastic member is a torsion spring.

The auxiliary ejecting device may further include a switch configured to be on and off based on contact with the other end of the auxiliary ejecting member when moved by the ice located in the rotating ice-making tray, to determine whether the ice-making tray completes the ice ejecting.

The auxiliary ejecting member may include an ice contacting portion configured to contact with the ice when the ice-making tray is rotated; and a switch contacting portion configured to contact with the switch after rotated together with the ice contacting portion, the switch contacting portion bent to be connected with the ice contacting portion.

The ice maker may further include a water-falling-preventing bracket provided in the ice-making tray to collect water generated when the ice located in the ice-making tray is ejected therein, for preventing the water from falling outside.

The water-falling-preventing bracket may include a slope surface configured to allow the collected water to flow into the ice-making tray when the ice-making restitutes after completing the ice ejecting.

The water-falling-preventing bracket may further include a heat-transmission-promoting member configured to transmit the heat of the heat source to the water-falling-preventing bracket efficiently, the heat-transmission-promoting member provided between the water-falling-preventing bracket and the heat source.

Advantageous Effects of Invention

The present invention has following advantageous effects.

According to a refrigerator including the ice maker, the ice may be securely ejected from the ice-making tray. As a result, reliability of ice ejecting may be improved.

Furthermore, the water generated when the ice is ejected in the ice maker may be prevented from falling to an ice container efficiently.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

As follows, an exemplary embodiment of the present invention will be described in the accompanying drawings.

Figure 1:
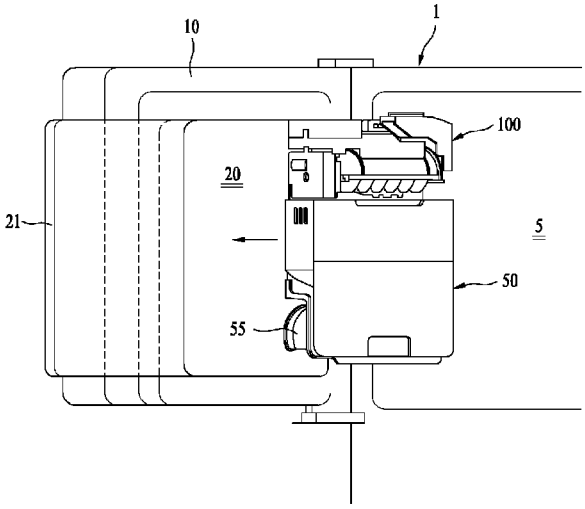
FIG. 1 is a diagram illustrating an ice maker and an ice bank which are mounted to a refrigerator according to the present invention.

As shown in FIG. 1, a refrigerator according to the present invention includes a cabinet 1 having a storage chamber 5 and a door 10 rotatably coupled to the cabinet 1 to open and close the storage chamber 5.

An ice-making chamber 20 is provided in the door 10 and an ice maker 100 is provided in the ice-making chamber 20 to make ice. An ice bank 50 may be provided below the ice maker 100 and the ice bank 50 contains the ice made in the ice maker 100 before discharging it to a dispenser (not shown).

Here, a motor part 55 configured to drive an ice discharging member (not shown) provided in the ice bank 50 may be provided in a rear portion of the ice bank 50.

An ice-making-chamber-door 21 is provided in a predetermined portion of the ice making chamber 20 and the ice-making-chamber-door 21 selectively closes the ice making chamber 20.

Figure 2:
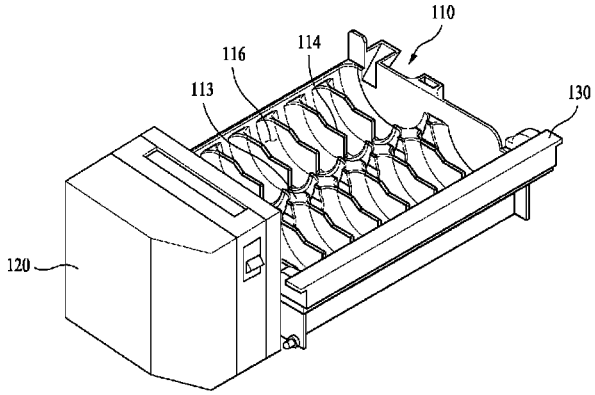
FIG. 2 is a perspective view illustrating an ice-making tray, a driving controller and a water-fall-preventing bracket provided in an ice maker according to an exemplary embodiment of the present invention.

As shown in FIG. 2, the ice maker 100 includes an ice-making tray 110 configured to make ice, a heat source (150, see FIG. 5) configured to heat the ice-making tray 110 to separate ice from the ice-making tray 110, an auxiliary ejecting device (200, see FIGS. 7 and 10) configured to press the ice when ejecting the ice rotated after heated by the heat source 150 to help the ice ejecting.

First of all, the structure of the ice-making tray 110 will be described in reference to FIGS. 2, 3 and 5.

As shown in FIG. 2, unit chambers 116 arranged in two rows to make ice therein, respectively, are formed in the ice-making tray 110 by partition plates 114. The partition plates 114 are arranged, spaced apart a predetermined distance from each other. Once water is supplied to a leftmost unit chamber, the partition plates 114 are formed to allow the water to flow toward the very next unit chambers smoothly in a leftward direction.

The driving controller 120 is connected to a predetermined portion of the ice-making tray 110 and it is configured to selectively rotate the ice-making tray 110 and to control the heat source 150 to be on and off. Also, this driving controller 120 controls the heat source 150 to be on to heat and rotate the ice-making tray 110, to separate the ice made of the water supplied to the ice-making tray 110 from the ice-making tray 110. after the ice is separated, the driving controller 120 controls the heat source 150 to be off and the ice-making tray 110 to be rotated reversely, such that the ice-making tray 110 may restitute.

Figure 4:
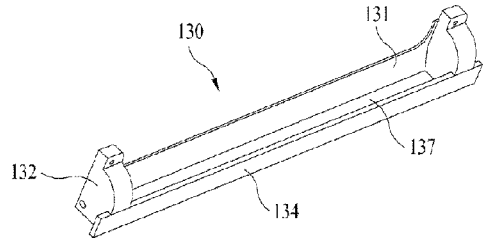
FIG. 4 is a perspective view illustrating the water-falling-preventing bracket of FIG. 3, seen from a top and a bottom thereof.
Figure 4:
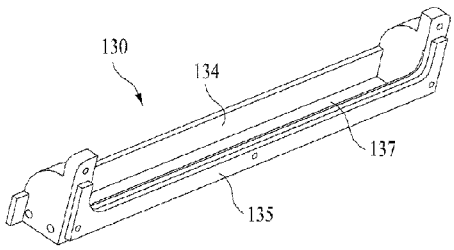

A water-falling-preventing bracket 130 may be provided in an upper surface corner of a front end of the ice-making tray 110. The water-falling-preventing bracket 130 is shown in FIGS. 4 and 5 in detail, which will be described later.

Figure 3:
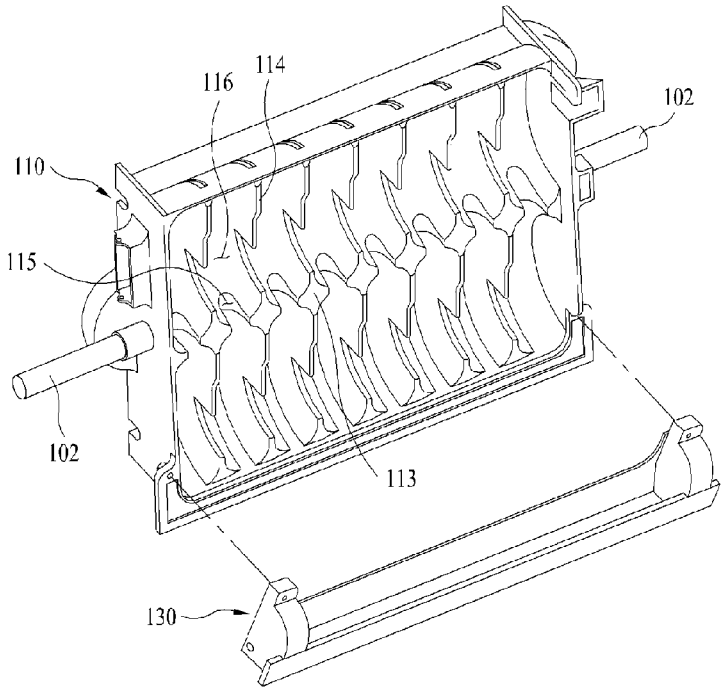
FIG. 3 is a perspective view illustrating the water-falling-preventing bracket secured to the ice-making tray.

As shown in FIG. 3, a shaft 102 is provided through both opposite sides of the ice-making tray 110 and an end of the shaft 102 is connected with a driving shaft of a motor (not shown) provided in the driving controller 120. The motor rotates the ice-making tray 110 within a predetermined range of angles in clockwise/counter-clockwise directions.

The water-falling-preventing bracket 130 is secured to the ice-making tray 110 by securing means such as screws via a screw hole formed in the upper surface corner of the front end of the ice-making tray 110.

In the meanwhile, rather than the partition plates and unit chambers 116, the ice-making tray 110 may include at least one uplifted portion 113 configured to distinguish upper unit chambers 116 from lower unit chambers 116. A path 115 is formed between each two of the uplifted portions 113 to allow the water supplied to the upper unit chambers to flow toward the lower unit chambers.

Next, in reference to FIGS. 5 and 6, the heat source configured to heat the ice-making tray 110 will be described.

Figure 5:
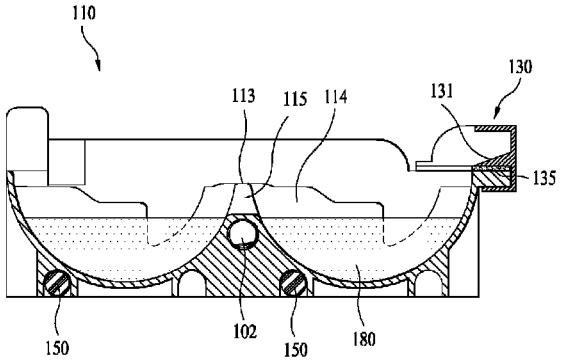
FIG. 5 is a side-sectional view illustrating the ice-making tray having two rows shown in FIG. 2.
Figure 6:
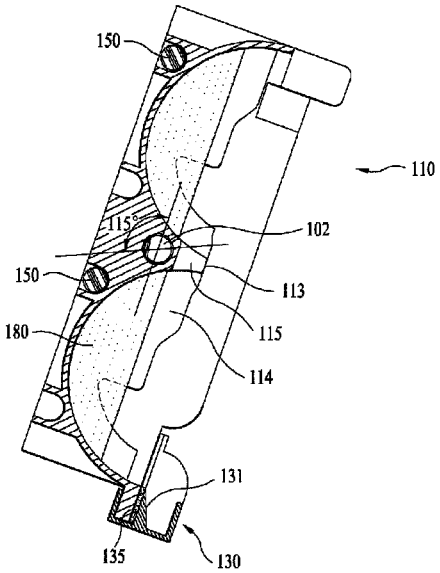
FIG. 6 is a side-sectional view illustrating the ice-making tray of FIG. 5 which is rotated.

As shown in FIGS. 5 and 6, a heater 150 as heat source configured to heat the ice-making tray 110 is provided in each row of the unit chambers 116, below the ice-making tray 110. The heater 150 may be mounted to contact with the ice-making tray 110 physically or mounted to be spaced apart a predetermined distance from the ice-making tray 110.

As shown in FIGS. 5 and 6, the heater 150 may be formed in a fan shape, arranged to across a bottom surface of the ice-making tray 110. Alternatively, although not shown in the drawings, the heater 150 may be formed in a plate shape, with surrounding the bottom surface of the ice-making tray 110. In this case, the heater 150 may be embodied to be a conductive polymer, plate heater with positive thermal coefficient, Al thin film and a variation of them. Alternatively, the heater 150 may be embedded in the ice-making tray 110 or provided in an inner surface of the ice-making tray 110. By extension, a predetermined element of the ice-making tray 110 is formed of resistant capable of generating heat when electricity is applied thereto, to be employed as heater.

Moreover, the heat source may be another element which is not the heater 150. rather than the examples described above, the heat source may be a light source configured to emit a light to at least one of the ice-making tray 110 and the ice 180 or a device including magnetron capable of emitting a microwave.

As described above, the heat source such as the heater, light source and magnetron applies thermal energy to at least one of the ice-making tray 110 and ice 180 or a border portion between them directly, to slightly melt at least predetermined area of the border portion between the ice-making tray 110 and the ice 180. because of that, when the ice-making tray 110 is rotated, the ice having the other not melted border portion there between may be separated from the ice-making tray 110 by its weight.

As a result, the ice maker according to the present invention may reduce energy usage because it can eject the ice only with a relatively small amount of energy, compared with the conventional ice maker. Of course, the amount of melted ice portion is relatively small according to the present invention and the water generated during the ice ejecting may be reduced. Because of that, the water falling to the ice bank 50 from the ice-making tray 110 may be reduced as much as possible.

In this time, if the heat source such as the heater and the like is arranged to heat the ice-making tray 110, the ice-making tray 110 is heated gradually to melt the border portion with the ice. However, an area of the border portion which is to the heat source is melted fast and more and another area which is distant from the heat source is melted slow and less. In other words, although the ice is ejected by rotating the ice-making tray 110, using the weight of the ice, the ice located in the border portion is melted partially more. Because of that, it is difficult to prevent the melted water from being generated too much completely.

As a result, the ice maker 100 according to the present invention may further include the water-falling-preventing bracket 130 which allows the water generated from the ice melted in the ice-making tray 110 to be collected therein. As shown in FIG. 6, the water-falling-preventing bracket 130 is provided in a predetermined portion of the ice-making tray 110 as shown in FIG. 6, specifically, in the corner of the ice-making tray 110 located lower when the ice-making tray 110 is rotated to eject the ice.

The structure of the water-falling-preventing bracket 130 will be described in detail in reference to FIGS. 4 to 6.

As mentioned above, the screw holes are formed in both side surfaces 132 of the water-falling-preventing bracket 130 to allow the water-falling-preventing bracket 130 secured to the ice-making tray 110.

A slope surface 131 is formed in a bottom of the water-falling-preventing bracket 130 to allow the water collected in the water-falling-preventing bracket 130 to smoothly re-flow toward the ice-making tray 110 when the ice-making tray 110 restitutes after completing the ice ejecting. Also, a ceiling part 134 having a predetermined width is formed in opposite to the slope surface and a perpendicular part 134 is formed between the slope surface 131 and the ceiling part 134. Such the slope surface 131, the side surface 132, the ceiling part 134 and the perpendicular part 137 are named based on a case in that the water-falling-preventing bracket 130 is located at an angle shown in FIG. 5.

The water generated from the ice having a melted border portion after the ice-making tray 110 located in such the ice-making position shown in FIG. 5 is heated and then rotated only to be an ice-ejecting position shown in FIG. 6 may flow along the slope surface 131 and be collected in a longitudinal recessed portion formed by the perpendicular part 137, the ceiling part 134 and both of the side surfaces 132.

It is preferable that, the water-falling-preventing bracket 130 is formed to receive water of 15 g~25 g. Based on the result of experiments performed with the two-row-ice-making tray according to the embodiment of the present invention, the amount of water falling during the ice ejecting is approximately 10 g. As a result, the water collecting amount of the water-falling-preventing bracket 130 may be 15 g~25 g in consideration of a safety coefficient.

In addition, the slope surface 131 may be slope by an angle of 15°~30° with respect to the bottom surface. If an angle of the slope surface 131 when the ice-making-tray 110 restitutes after completing the ice ejecting is too small, the water would be stuck to the slope surface 131 by a surface tension only to allow the water to fail to fall toward the ice-making tray. In contrast, if the angle of the slope surface 131 is too large, the amount of water capable of being collected in the longitudinal recessed portion of the water-falling-preventing bracket 130 when the ice-making tray 110 is rotated to be the ice ejecting position would be reduced and the water happens to overflow the ceiling part 134.

Furthermore, the water-falling-preventing bracket 130 may include a heat-transmission-promoting member 135 provided between the heat source and itself and the heat-transmission-promoting member 135 allows the heat of the heat source to be transmitted to the water-falling-preventing bracket 130 efficiently.

The ice maker 100 including the ice-making tray 110 and the water-falling-preventing bracket 130 may be provided in the ice-making chamber 20. As a result, cold air may be always supplied to both of the ice-making tray 110 and the water-falling-preventing bracket 130. Once the ice-making tray 110 is rotated to be the ice ejecting position after heated by the heater 150, the water generated in the ice-making tray 110 might be frozen in the water-falling-preventing bracket 130 because of the cold air.

If water is supplied to the ice-making tray 110 after restitutes to be the ice-making position in this state and if the ice-making tray 110 is heated and rotated after that, the ice remaining in the water-falling-preventing bracket 130 might cause the amount of water collectable in the water-falling-preventing bracket 130 might be noticeably reduced only to make the water overflow.

As a result, the heat-transmission-promoting member 135 is provided a lower portion of the water-falling-preventing bracket 130. Because of that, the heater 150 is re-heated when the ice-making tray 110 restitutes and the ice which could remain in the water-falling-preventing bracket 130 may be then melted.

As follows, the auxiliary ejecting device 200 will be described in reference to FIGS. 7 to 12.

Figure 7:
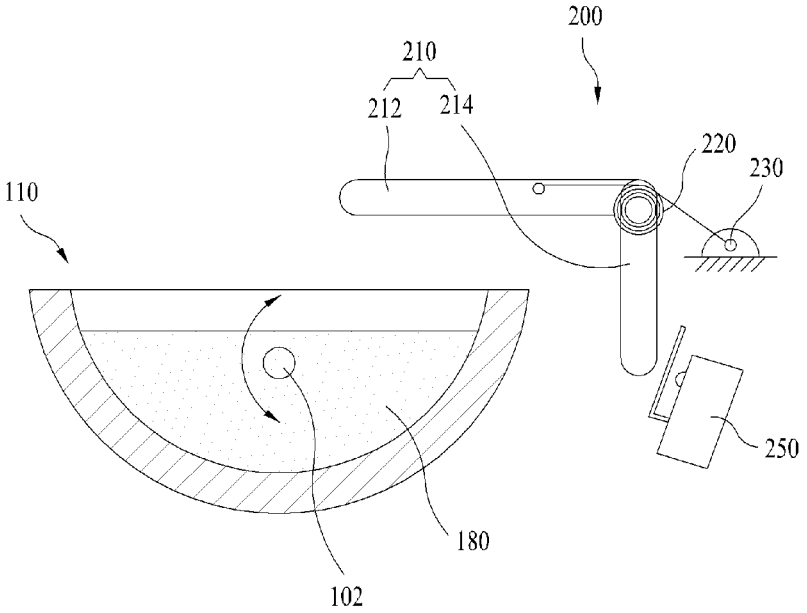
FIG. 7 is a diagram schematically illustrating an ice-making tray having a single row and an auxiliary-ejecting member according to another embodiment of the present invention.
Figure 8:
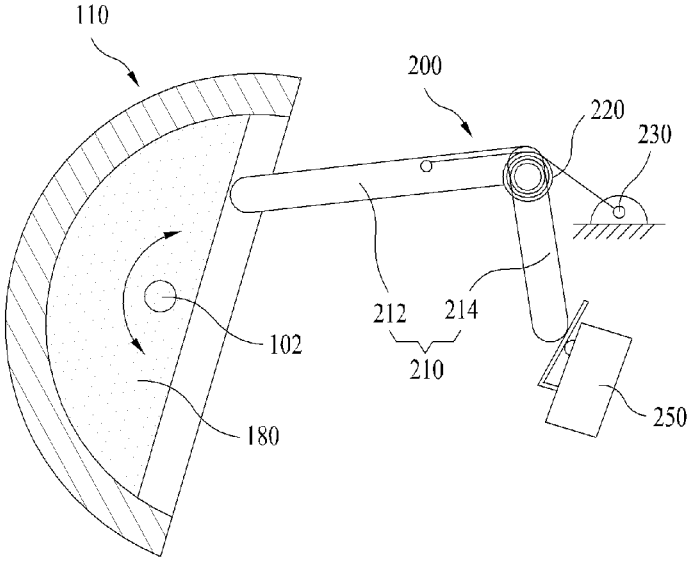
FIG. 8 is a diagram schematically illustrating the ice-making tray of FIG. 7 which is rotated only to make ice contact with the auxiliary-ejecting member.
Figure 9:
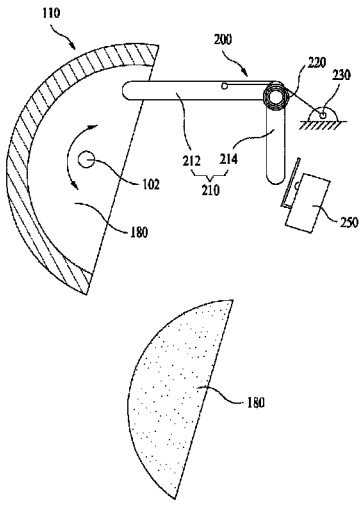
FIG. 9 is a diagram schematically illustrating the auxiliary-ejecting member of FIG. 7 which restitutes after pushing to eject ice located in the ice-making tray.

FIGS. 7 to 9 are diagrams schematically illustrating an operational relation between rotation of an ice-making tray 110 having single-row unit chambers 116 and the auxiliary-ejecting device 200. Here, the heater 150 as the heat source is omitted and also the water-falling-preventing bracket 130 is omitted.

Figure 10:
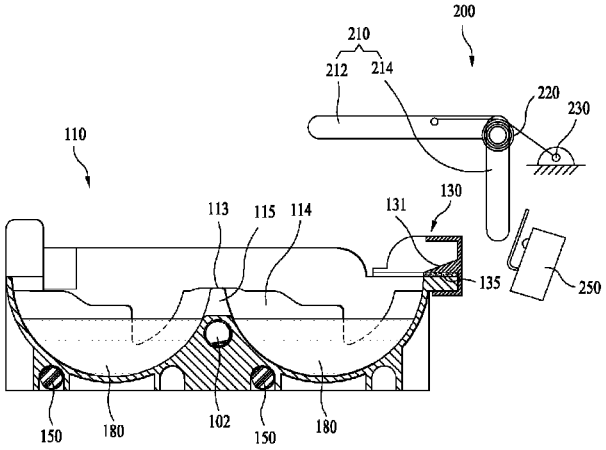
FIG. 10 is a diagram schematically illustrating an ice-making tray having two rows and an auxiliary ejecting member according to a further embodiment of the present invention.
Figure 11:
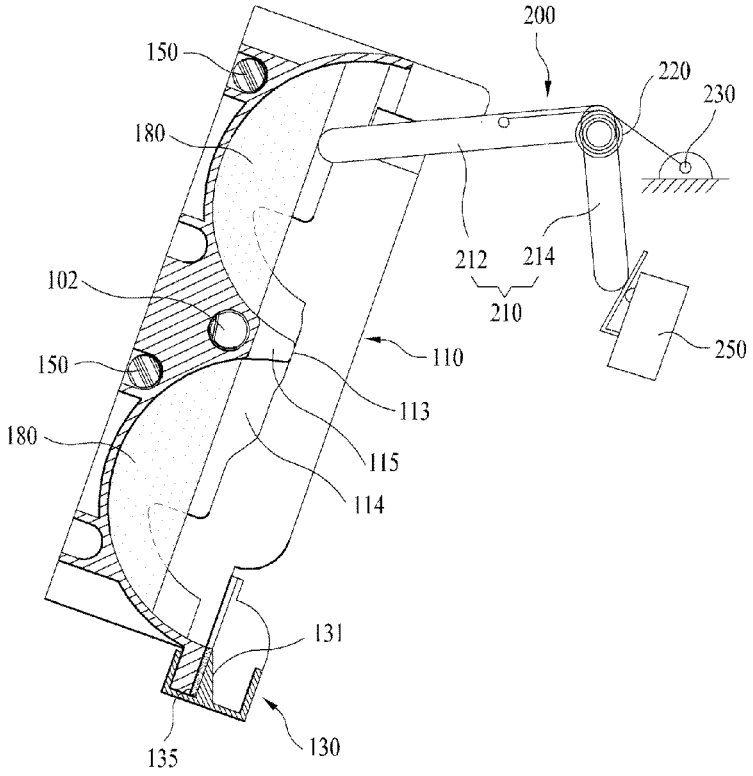
FIG. 11 is a diagram schematically illustrating the ice-making tray of FIG. 10 which is rotated only to make ice contact with the auxiliary ejecting member.
Figure 12:
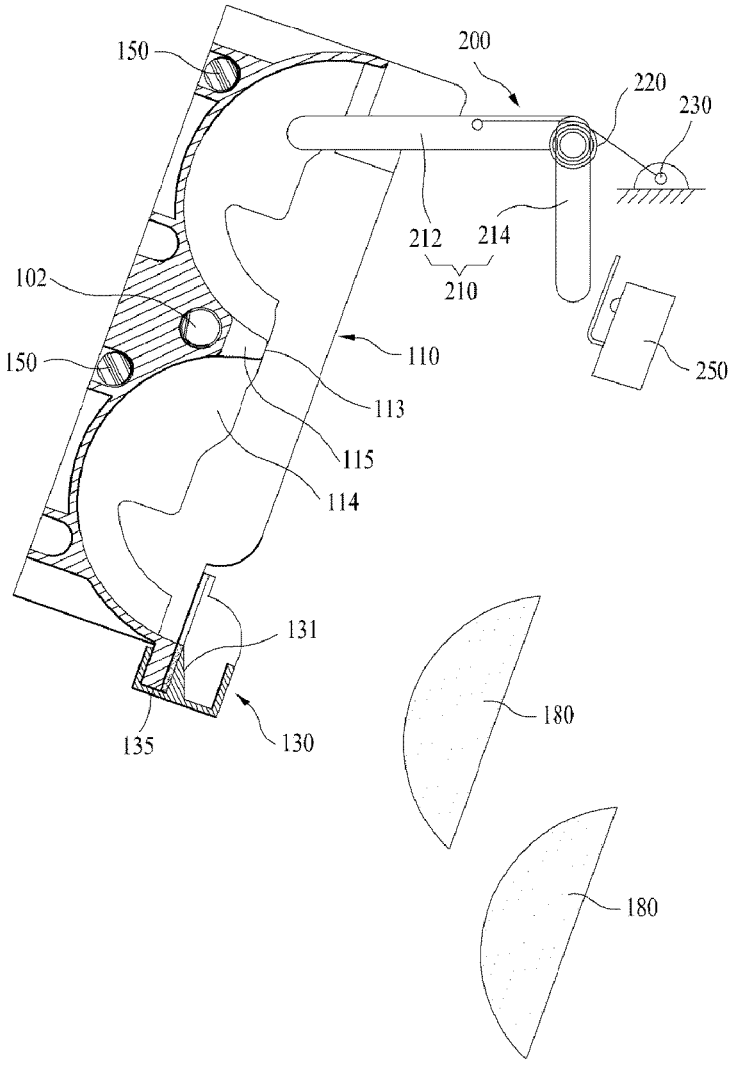
FIG. 12 is a diagram schematically illustrating the auxiliary ejecting member of FIG. 10 which restitutes after pushing ice located in the ice-making tray.

FIGS. 10 to 12 are diagrams schematically illustrating an operational relation between rotation of an ice-making tray having two-row unit chambers 116 and the auxiliary ejecting device 200.

The auxiliary ejecting device 200 includes an auxiliary ejecting member 210 having an end in contact with the ice 180 to eject the ice and an elastic member 220 configured to allow the auxiliary ejecting member 210 after ejecting the ice to restitute.

In addition, the auxiliary ejecting device 200 may include a switch 250 configured to be on and off based on contact with the other end of the auxiliary ejecting member 210, when the auxiliary ejecting member 210 is moved by the ice 180 of the rotating ice-making tray 110, to determine whether the ice-making tray completes the ice ejecting.

The auxiliary ejecting member 210 includes an ice contacting portion 212 configured to contact with the ice when the ice-making tray 110 is rotated and a switch contacting portion 214 bent to be connected with the ice contacting portion. The ice contacting portion 212 and the switch contacting portion 214 may be integrally formed or formed of predetermined separate members, respectively. The switch contacting portion 214 pushes the switch 250 arranged adjacent to an end of the switch contacting portion 214, when the ice contacting portion 212 is rotated by the ice to a predetermined angle.

The auxiliary ejecting member 210 may be configured to be rotatable within a predetermined range of angles with respect to a point at which the ice contacting portion 212 and the switch contacting portion 214 meet. A torsion spring 220 is wound around the driving shaft as the elastic member, to allow the auxiliary ejecting member rotated by the ice to restitute. An end of the torsion spring 220 is fixed to a middle of the ice contacting portion 212 and the other end thereof is fixed to an fixing end 230 provided in a wall of the ice maker 100.

The elastic member may be a compression spring (not shown). In this case, the auxiliary ejecting member 210 is not configured to be rotatable but to be sliding-movable along a horizontal direction. The compression spring may be configured to be compressed horizontally to a rear end of the auxiliary ejecting member 210. Also, the switch contacting portion 214 may include a horizontally extended part from a rear side surface which press the switch 250, not be a bar extendible downward.

The switch 250 to be on and off based on the contact with the switch contacting portion 214 may be located adjacent to the other end of the auxiliary ejecting member 210, which is the end of the switch contacting portion 214 specifically. This switch 250 may be a switch simply pressed by the rotation of the auxiliary ejecting member 210 to be one and off, or it may be a switch to be on and off based on contact with the auxiliary ejecting member 210.

In reference to FIGS. 7 to 9, the relation between the rotation of the single-row ice-making tray 110 and the auxiliary ejecting device 200 will be described.

As shown in FIG. 7, the water supplied to the ice-making tray 110 located in a horizontal ice making position is frozen to be ice 180. The ice-making tray 110 may be rotatable in clockwise and counter-clockwise directions with respect to the shaft 102. Specifically, the ice-making tray 110 is rotated in the clockwise direction in a state of FIG. 7 and in the counter-clockwise direction in a state of FIG. 9.

After the heater 150 heats the ice-making tray located in the ice making position of FIG. 7, the driving controller 120 rotates the ice-making tray 110 as shown in FIG. 8 and a surface of the ice located in the ice-making tray 110 pushes the end of the ice contacting portion 212 of the auxiliary ejecting member 210. at this time, a time point of the contact between the ice and the auxiliary ejecting member is when the ice-making tray 110 passes an angle of 90° and the ice contacting portion 212 of the auxiliary ejecting member 210 is rotated to be located downward.

If the ice is not separated from the ice-making tray 110 even after contacting with the auxiliary ejecting member 210, the ice contacting portion 212 may move downward continuously, with sliding from the surface of the ice 180. At this time, the switch contacting portion 214 of the auxiliary ejecting member 210 pushes the switch 250 to be on, with being rotated in the counter-clockwise direction.

In the meanwhile, the ice 180 inside the ice-making tray 110 might fall to be ejected before contacting with the auxiliary ejecting member 210 because of its weight. If then, as shown in FIG. 9, the auxiliary ejecting member 210 is not rotated any more and the switch may maintain an off-state accordingly.

When the ice 180 is pushed to be ejected by the auxiliary ejecting member 180 as shown in FIG. 9, the auxiliary ejecting member 210 may be restituted by the torsion spring 220. At this time, the switch pressed by the switch contacting portion 214 of the auxiliary ejecting member 210 may be restituted to be off.

If then, the driving controller 120 determines that the ice ejecting of the ice-making tray 10 is complete and it controls the heater 150 to be off. After that, the driving controller 120 rotates the ice-making tray 120 in the counter-clockwise direction to restitute the ice-making tray 120.

In case the ice 180 is not separated even when the ice-making tray 110 is rotated completely to eject the ice, the switch 250 may be controlled to maintain the on-state continuously. In this case, the driving controller 120 determines that the ice ejecting is not completed yet and continues the ice ejecting, until the switch is off after being on by the contact with the auxiliary ejecting member 210. In other words, the driving controller 120 maintains the on-state of the heater 150 to heat the ice-making tray 110 continuously. If the switch 250 maintains the on-state continuously even in a predetermined time period after the operation of the heater, the driving controller 120 controls the ice-making tray 110 to be rotated in the counter-clockwise direction and to re-perform the ice ejecting.

The ice maker 100 according to the present invention adapts the ejecting type using the ice-making tray. Because of that, the shock required to eject the ice in the state of the ice-making tray 110 being rotated to be the ice ejecting position may be relatively very small. According to the present invention, the auxiliary ejecting device allows the ice ejecting of the ice-making tray to be performed securely and the reliability of the ice maker to be improved.

As follows, the relation between the rotation of the two-row-ice-making tray 110 and the auxiliary ejecting device 200 will be described in reference to FIGS. 10 to 12. According to this embodiment, the water-falling-preventing bracket 130 is secured to the ice-making tray 110.

Also, the ice supplied to the ice-making tray 110 located in the horizontal-ice-making position is frozen to be the ice 180. The ice-making tray 110 may be rotatable in the clockwise and counter-clockwise directions. Specifically, the ice-making tray 110 may be rotated in the clockwise direction in a state of FIG. 10 and it may be rotated in the counter-clockwise direction in a state of FIG. 12.

After the heater 150 heats the ice-making tray 110 located in the ice-making position of FIG. 10, the driving controller 120 rotates the ice-making tray 110 as shown in FIG. 11 and the surface of the ice located in the ice-making tray 110 pushes the end of the ice contacting portion 212 of the auxiliary ejecting member 210. at this time, a time point when the ice is contacting with the auxiliary ejecting member 210 is when the ice-making tray 110 passes the angle of 90°. Because of that, the ice-making tray 110 is rotated to locate the ice contacting portion 212 of the auxiliary ejecting member 210 in a down position.

It is preferable that the ice-making tray 110 is heated and rotated at 110°~120° with respect to the horizontal surface. Especially, as shown in FIG. 6, the ice-making tray 110 may be rotated at the maximum angle of 115°. This maximum angle is calculated as optimal value which enables the auxiliary ejecting member 210 to be rotated after contacting with the ice 180, with enabling the water collected in the water-falling-preventing bracket 130 not to overflow the ceiling part 134.

The auxiliary ejecting member 210 may be configured to start to contact with the ice 180 located in the ice-making tray 110 at an angle of 5°~15° before the ice-making tray 110 is rotated completely. For example, if the ice-making tray 110 is rotated at the maximum angle of 115°, the ice contacting portion 212 of the auxiliary ejecting member 210 starts to contact with the ice, with the ice-making tray 110 being rotated at an angle of 100°~110°. Because of that, the auxiliary ejecting member 210 may be rotated in the predetermined angle range and the modulus of elasticity of the torsion spring 220 may be designed appropriately in consideration of the angle range.

If the ice 180 is not separated from the ice-making tray 110 even after contacting with the auxiliary ejecting member 210, the ice contacting portion 212 falls down continuously, with sliding along the surface of the ice 180. at this time, the switch contacting portion 214 of the auxiliary ejecting member 210 pushes the switch 250 to be on, with being rotated in the counter-clockwise direction.

In the meanwhile, the ice 180 located in the ice-making tray 110 may fall to be ejected because of its weight before contacting with the auxiliary ejecting member 210. In this case, as shown in FIG. 12, the auxiliary ejecting member 210 is not rotated and the switch 250 may maintain the off-state accordingly.

As shown in FIG. 12, when the ice 180 is pushed to be ejected by the auxiliary ejecting member 210, the auxiliary ejecting member 210 is restituted by the torsion spring 220. At this time, the switch 250 in the on-state after pushed by the switch contacting portion 214 may be restituted to be in the off-state.

If the switch maintains the on-state after contacting with the auxiliary ejecting member 210, the driving controller 120 determines that the ice ejecting of the ice-making tray 110 is not completed and it controls the ice ejecting to be performed continuously until the switch is off.

In this case, the driving controller 120 maintains the on-state of the heater 150 and the heater 150 to heats the ice-making tray continuously until the ice ejecting is completed. Also, after restituting the ice-making tray 110, the driving controller 120 re-heats and rotates the ice-making tray 110 to eject ice.

Although the ice maker according to the above embodiments is described, a refrigerant including the ice maker pertains to a scope of the present invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. An ice maker comprising:

an ice-making tray configured to make ice;

a heat source configured to heat the ice-making tray to eject the ice from the ice-making tray;

a driving controller configured to rotate the ice-making tray selectively and to control the heat source to be on and off; and an auxiliary ejecting device configured to press an upper surface of the ice to help the ice ejecting when the ice-making tray heated by the heat source is rotated to eject the ice, wherein the auxiliary ejecting device includes:

an auxiliary ejecting member being rotatable with respect to a shaft secured over the ice-making tray and having a first end to contact the upper surface of the ice to eject the ice, an elastic member configured to restitute the auxiliary ejecting member after the ice is ejected, and a switch configured to be on and off based on contact with a second end of the auxiliary ejecting member when the auxiliary ejecting member is moved by the ice in the rotating ice-making tray, to determine whether the ice-making tray completes the ejecting of the ice.

2. The ice maker as claimed in claim 1, wherein the elastic member is a torsion spring.

3. The ice maker as claimed in claim 1, wherein the auxiliary ejecting member includes:

an ice contacting portion configured to contact the ice when the ice-making tray is rotated; and a switch contacting portion configured to contact the switch after being rotated together with the ice contacting portion, the switch contacting portion bent to connect with the ice contacting portion.

4. The ice maker as claimed in claim 1, wherein the driving controller determines that the ice ejecting is not completed and the driving controller continues the ice ejecting until the switch is off after the auxiliary ejecting member contacts the switch to allow the switch to be on.

5. The ice maker as claimed in claim 1, wherein the ice-making tray, after heated to eject the ice, is rotated at a predetermined angle more than 90° and the auxiliary ejecting member starts to contact the ice in the ice-making tray just before the rotation of the ice-making tray is completed.

6. The ice maker as claimed in claim 1, further comprising:

a water-falling-preventing bracket provided in the ice-making tray to collect water generated when the ice located in the ice-making tray is ejected therein, for preventing the water from falling outside.

7. The ice maker as claimed in claim 6, wherein the water-falling-preventing bracket includes:

a slope surface configured to allow the collected water to flow into the ice-making tray when the ice-making restitutes after completing the ice ejecting.

8. The ice maker as claimed in claim 6, wherein the slope surface is oblique downward to the ice-making tray with respect to a horizontal surface.

9. The ice maker as claimed in claim 6, wherein the water-falling-preventing bracket further includes:

a heat-transmission-promoting member configured to transmit the heat of the heat source to the water-falling-preventing bracket efficiently, the heat-transmission-promoting member provided between the water-falling-preventing bracket and the heat source.

10. A refrigerator comprising:

a cabinet including a storage chamber;

a door rotatably coupled to the cabinet to open and close the storage chamber; and an ice maker provided in the storage chamber or the door, the ice maker including:

an ice-making tray configured to make ice;

a heat source configured to heat the ice-making tray to eject the ice from the ice-making tray;

a driving controller configured to rotate the ice-making tray selectively and to control the heat source to be on and off; and an auxiliary ejecting device configured to press an upper surface of the ice to help the ice ejecting when the ice-making tray heated by the heat source is rotated to eject the ice, wherein the auxiliary ejecting device includes:

an auxiliary ejecting member being rotatable with respect to a shaft secured over the ice-making tray and having a first end to contact the upper surface of the ice to eject the ice;

an elastic member configured to restitute the auxiliary ejecting member after the ice is ejected; and a switch configured to be on and off based on contact with a second end of the auxiliary ejecting member when the auxiliary ejecting member is moved by the ice in the rotating ice-making tray, to determine whether the ice-making tray completes the ejecting of the ice.

11. The refrigerator as claimed in claim 10, wherein the elastic member is a torsion spring.

12. The refrigerator as claimed in claim 10, wherein the auxiliary ejecting member includes:

an ice contacting portion configured to contact the ice when the ice-making tray is rotated; and a switch contacting portion configured to contact the switch after being rotated together with the ice contacting portion, the switch contacting portion bent to connect with the ice contacting portion.

13. The refrigerator as claimed in claim 10, wherein the ice maker further includes:

a water-falling-preventing bracket provided in the ice-making tray to collect water generated when the ice located in the ice-making tray is ejected therein, for preventing the water from falling outside.

14. The refrigerator as claimed in claim 13, wherein the water-falling-preventing bracket includes:

a slope surface configured to allow the collected water to flow into the ice-making tray when the ice-making restitutes after completing the ice ejecting.

15. The refrigerator as claimed in claim 13, wherein the water-falling-preventing bracket further includes:

a heat-transmission-promoting member configured to transmit the heat of the heat source to the water-falling-preventing bracket efficiently, the heat-transmission-promoting member provided between the water-falling-preventing bracket and the heat source.

* * * * *